United States Patent [19]

Drake

[11] Patent Number: 5,017,941

[45] Date of Patent: May 21, 1991

[54] THERMAL INK JET PRINTHEAD WITH RECIRCULATING COOLING SYSTEM

[75] Inventor: Donald J. Drake, Rochester, N.Y.

[73] Assignee: Xerox Corporation, Stamford, Conn.

[21] Appl. No.: 432,247

[22] Filed: Nov. 6, 1989

[51] Int. Cl.[5] ..... B41J 2/05

[52] U.S. Cl. ..... 346/1.1; 346/140R; 361/385

[58] Field of Search ..... 346/140, 76 PH, 1.1; 400/719, 124 TC, 126; 361/385, 382, 383

[56] References Cited

U.S. PATENT DOCUMENTS

| | | | |
|---|---|---|---|
| Re. 32,572 | 1/1988 | Hawkins et al. | 156/626 |
| 3,524,497 | 8/1970 | Chu | 361/385 X |
| 4,532,530 | 7/1985 | Hawkins | 346/140 R |
| 4,579,469 | 4/1986 | Falcetti | 400/719 X |
| 4,638,337 | 1/1987 | Torpey et al. | 346/140 R |
| 4,704,620 | 11/1987 | Ichihashi et al. | 346/140 R |
| 4,774,630 | 9/1988 | Reisman | 361/383 |
| 4,791,440 | 12/1988 | Eldridge | 346/140 |
| 4,831,390 | 5/1989 | Deshpande et al. | 346/140 R |
| 4,896,172 | 1/1990 | Nozawa | 346/140 |

*Primary Examiner*—Joseph W. Hartary

*Attorney, Agent, or Firm*—Robert A. Chittum

[57] ABSTRACT

A thermal ink jet printer is disclosed having a printhead with a passageway therein for the circulation of a cooling fluid therethrough. The passageway is parallel and closely adjacent the array of bubble generating heating elements. When the printhead is composed of mated silicon channel and heater plates, the passageway is formed in one embodiment by forming a groove in the heater plate surface opposite the one containing the heating elements and addressing electrodes followed by the mating of a silicon sealing plate having inlet and outlet openings etched therein. Tubes for circulating a cooling fluid, such as ink, are sealingly attached to the inlet and outlet openings. In an alternative embodiment, the groove may be formed in the sealing plate or in both the sealing plate and the printhead heater plate. In another embodiment, the passageway for the cooling fluid is provided by etching a channel in a thick film layer deposited on the heater plate surface opposite the one with the heating elements. The circulated cooling fluid prevents printhead temperature fluctuations during the printing operation.

14 Claims, 10 Drawing Sheets

THERMAL INK JET PRINTHEAD WITH RECIRCULATING COOLING SYSTEM

BACKGROUND OF THE INVENTION

1. Field of the Invention

This invention relates to thermal ink jet printing devices and, more particularly, to improved printheads which have a recirculating cooling system to regulate temperature that is located directly under the heating elements which expel ink droplets on demand.

2. Description of the Prior Art

Thermal ink jet printing is generally a drop-on-demand type of ink jet printing which uses thermal energy to produce a vapor bubble in an ink-filled channel that expels a droplet. A thermal energy generator or heating element, usually a resistor, is located in the channels near the nozzle a predetermined distance therefrom. The resistors are individually addressed with an electrical pulse to momentarily vaporize the ink and form a bubble which expels an ink droplet.

It is well known that print quality is affected as the device heats up. In particular, if the device heats up too high (e.g., during extended high density printing), then it tends to lose prime, and one or more ink channels of the printhead cease to expel droplets. A less catastrophic defect, but still one that degrades print quality, is the increase in printed spot or pixel size as a function of device temperature. Many of the prior art devices incorporate a heat sink of sufficient thermal mass and of low enough thermal resistance that the device temperature does not rise excessively. For one example of a thermal ink jet printhead having a heat sink, refer to U.S. Pat. No. 4,831,390 to Deshpande et al. This approach has eliminated the catastrophic printing failure mode. However, to lower the thermal resistance to the heat sink sufficiently that there is no appreciable device temperture rise in the time scale of a carriage translation in one direction across the paper, it may be necessary to take packaging approaches which would increase the cost or otherwise constrain the printer design in an undesirable way. The problem is expected to be worse as array size is increased.

U.S. Pat. No. Re. 32,572 to Hawkins et al discloses a thermal ink jet printhead and method of fabrication. A plurality of printheads are concurrently fabricated by forming a plurality of sets of heating elements with their individual addressing electrodes on one substrate surface and etching corresponding sets of grooves which may serve as ink channels with a common reservoir in the surface of a silicon wafer. The wafer and substrate are aligned and bonded together so that each channel has a heating element. The individual printheads are obtained by milling away the unwanted silicon material in the etched wafer to expose the addressing electrode terminals on the substrate and then the bonded structure is diced into a plurality of separate printheads.

U.S. Pat. No. 4,638,337 to Torpey et al discloses an improved thermal ink jet printhead similar to that of Hawkins et al, but has each of its heating elements located in a recess. The recess walls containing the heating elements prevent the lateral movement of the bubbles through the nozzle and therefore the sudden release of vaporized ink to the atmosphere, known as blowout, which causes ingestion of air and interrupts the printhead operation whenever this event occurs. In this patent, a thick film organic structure such as Riston® is interposed between the heater plate and the channel plate. The purpose of this layer is to have recesses formed therein directly above the heating elements to contain the bubble which is formed over the heating element to enable an increase in droplet velocity without the occurrent of vapor blowout.

U.S. Pat. No. 4,774,530 to Hawkins discloses a two part printhead comprising a channel plate and a heater plate similar to the printhead of U.S. Pat. No. 4,638,337 to Torpey et al, but having a second pit or groove in the thick film layer sandwiched between the channel and heater plates. This second groove in the thick film layer is located so that the ink may flow from the reservoir to the ink channels even though the etched channel grooves do not connect to the adjacent etched reservoir recess.

U.S. Pat. No. 4,704,620 to Ichihashi et al discloses a multi-color ink jet printer having a plurality of printheads, one for each color, and each printhead has a temperature sensor. A temperature control system activates one or both fans on each side of the spaced, parallel printheads depending on the temperature of the individual printheads.

SUMMARY OF THE INVENTION

It is the object of the present invention to provide an improved thermal ink jet printhead which prevents printhead temperature fluctuations during printing.

It is another object of the invention to regulate the printhead temperature by circulating a cooling fluid through the printhead.

It is still another object of the invention to provide a cooling path on or in the surface of the printhead substrate opposite the one containing the bubble generating heating elements, the cooling path being aligned therewith to provide minimum substrate material thickness between the heating elements and cooling path.

It is yet another object of the invention to provide a cooling groove in the bottom surface of a printhead substrate containing the heating elements on the top surface thereof, the cooling groove being positioned directly under the heating elements, so that the cooling groove forms a fluid directing tunnel when a sealing substrate is bonded thereto which may also act as a heat sink.

In the present invention, a thermal ink jet printhead of the type having an ink supply manifold and a plurality of parallel ink channels with each having a nozzle in one component part and a plurality of heating elements on the adjacent surface of a second component part is improved by means for preventing excessive printhead temperature fluctuations by the circulation of a cooling fluid through a coolant path directly under the heating elements. The coolant path may be an etched thick film layer, an etched groove therein, or a combination of both. In the printing mode, the printhead ejects ink droplets on demand by the selective energization of the heating elements with electrical pulses to vaporize instantaneously the ink in contact with the energized heating element, so that temporary vapor bubbles are formed which eject the ink droplet. A plurality of individual printheads are produced by dicing aligned and mated silicon wafers processed to have a plurality of sets of heating elements on one wafer and a plurality of sets of ink channels and associated inlet/reservoirs on the other. The improvement comprises forming a cooling path for each set of heating elements, such as, for example, by forming a groove in the side of the wafer opposite the one which will subsequently contain the heating elements or patterning a passageway in a thick film polymer layer deposited thereon. Prior to the fabricating of heating elements and addressing electrodes, the cooling grooves are produced by dicing or etching. The cooling passageway patterned in the thick film layer is done after the heating elements and addressing electrodes are fabricated. In the preferred embodiment, a thick film polymer insulative layer is formed over the heating elements and electrodes and patterned to expose the heating elements and electrode terminals and to produce elongated grooves for placing each of the reservoirs into communication with its respective set of ink channels. If the cooling passageways in a thick film layer are used, the thick film layer is patterned concurrently with the layer over the heating elements on the opposite surface of the heater plate wafer. A third silicon wafer is etched to provide a plurality of pairs of through openings. The pairs of etched openings are located so that, when this third wafer is aligned and bonded to the surface of the wafer containing the cooling grooves or the intermediate patterned thick film layer, each etched pair of openings may function as inlet and outlet for the circulation of a cooling fluid. Tubes, for example, are sealingly attached to the pairs of openings after the three wafers are mated and diced into individual printheads. The attachment of the tubes may be accomplished when the daughterboard is attached, by inserting the tubes in holes or slots at predetermined locations in the daughterboard prior to assembly with the printhead. Once the third wafer is mated to the wafer having the heating elements, the cooling grooves or patterned thick film layer are formed into a tunnel which is accessed only by the etched openings in the third wafer.

In an alternate embodiment, the cooling grooves are placed in one surface of the third wafer after pairs of recesses are etched in the opposite surface, so that the bottom of each groove intersects an associated pair of recesses. Therefore, the third wafer contains the fluid circulating cooling passageways and the printhead fabrication process may be unaffected until mated with the third wafer just prior to dicing into individual printheads. Optionally, the cooling groove could also be formed in the printhead part having the heating elements for greater mass of fluid circulated through the cooling passageways, or an intermediate thick film layer with patterned cooling passageways could be used to provide the extra cooling capacity.

A more complete understanding of the present invention can be obtained by considering the following detailed description in conjunction with the accompanying drawings, wherein like parts have the same index numerals.

DESCRIPTION OF THE PREFERRED EMBODIMENT

Figure 1:
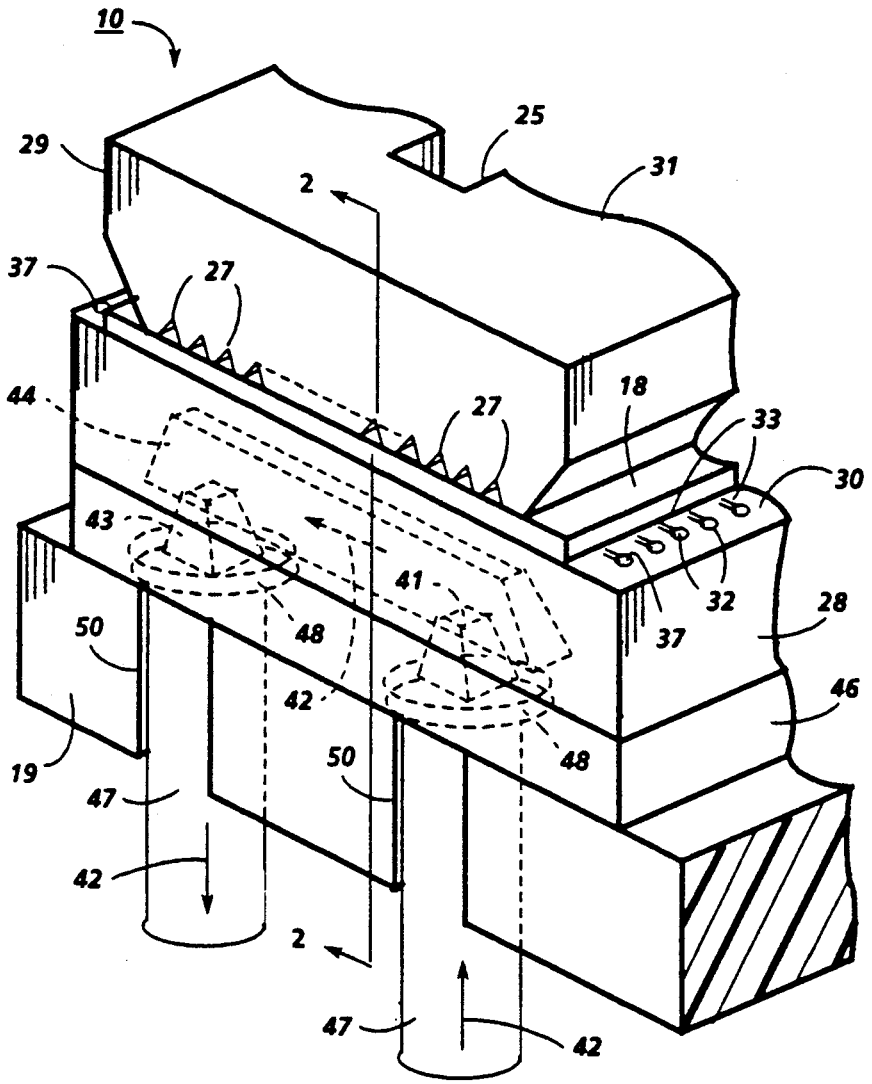
FIG. 1 is a schematic, partial isometric view of a printhead showing one embodiment of the circulating fluid passageways of the present invention in dashed line.
Figure 2A:
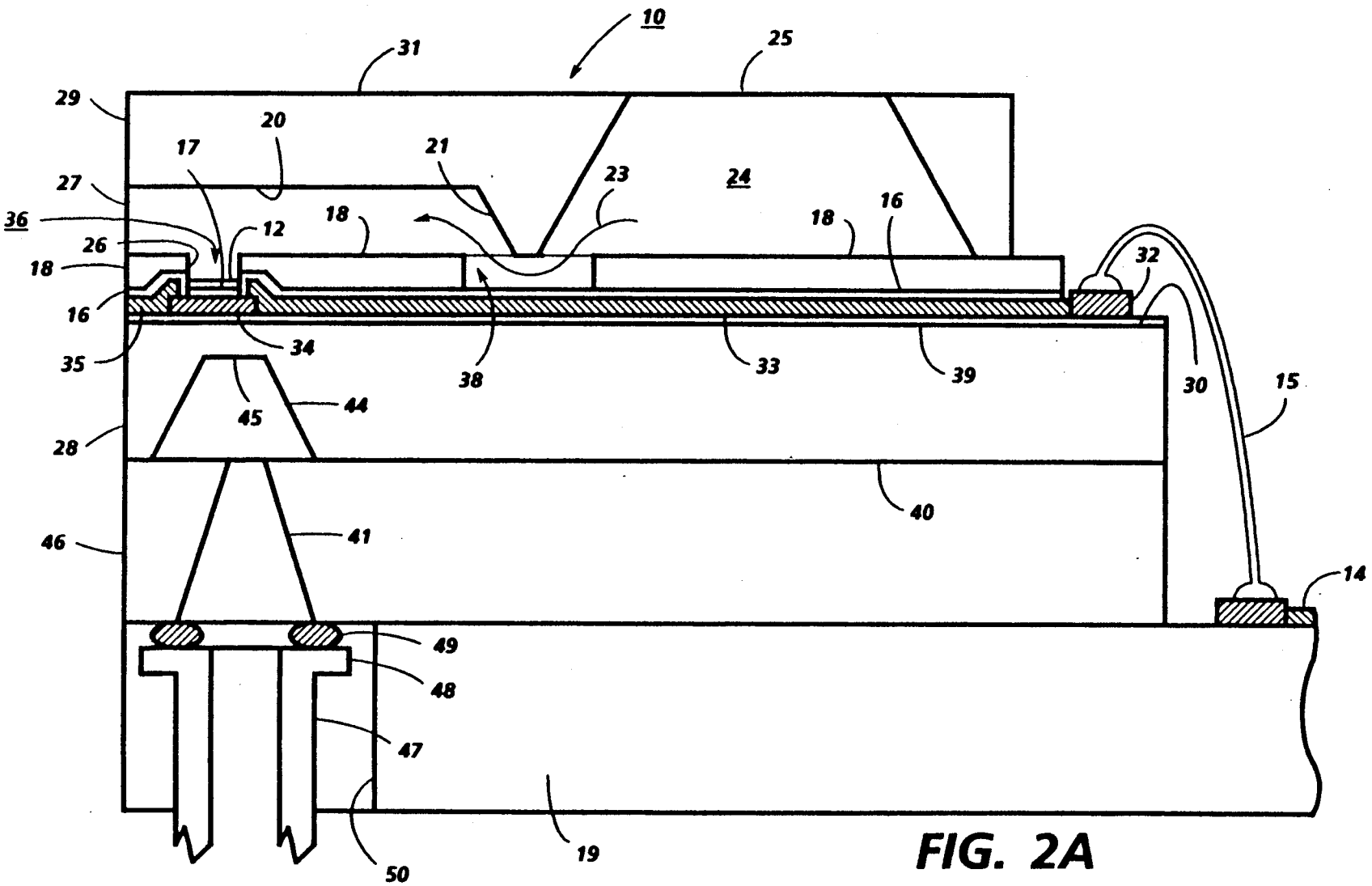
FIG. 2A is a cross sectional view of the printhead as viewed along view line 2—2 of FIG. 1.

Referring to FIG. 1, an enlarged, schematic isometric view of the improved thermal ink jet printhead 10 of the present invention is shown, depicting an array of droplet emitting nozzles 27 in the front face 29 of the printhead. Referring also to FIG. 2A, discussed later, the lower electrically insulating substrate or heater plate 28 has the multi-layered, thermal transducers 36, including the heating elements 34, and addressing electrodes 33 patterned on surface 30 thereof, while the upper substrate or channel plate 31 has parallel grooves 20 which extend in one direction and penetrate through the upper substrate front face edge 29. The other end of grooves terminate at slanted wall 21. The internal recess 24, which is used as the ink supply manifold for the capillary filled ink channels 20, has an open bottom 25 for use an an ink fill hole. The surface of the channel plate with the grooves are aligned and bonded to the patterned thick film layer 18 deposited on the heater plate 28, so that a respective one of the plurality of heating elements 34 is positioned in each channel, formed by the grooves and the lower substrate or heater plate. Ink enters the manifold formed by the recess 24 and the lower substrate 28 through the fill hole 25 and, by capillary action, fills the channels 20 by flowing through an elongated recess 38 formed in the thick film insulative layer 18. The ink at each nozzle forms a meniscus, the surface tension of which, together with the slight negative pressure of the ink supply, prevents the ink from weeping therefrom. The addressing electrodes 33 on the lower substrate or channel plate 28 terminate at terminals 32. The channel plate 31 is smaller than that of the heater plate in order that the electrode terminals 32 are exposed and available for bonding of wire bonds 15 to the electrodes 14 on the daughter board 19, on which the printhead 10 is permanently mounted. Layer 18 is a thick film passivation layer, discussed later, sandwiched between channel and heater plates. This layer is etched to expose the heating elements, thus placing them in a pit 26, and is etched to form the elongated recess 38 to enable ink flow between the manifold 24 and the ink channels 20. In addition, the thick film insulative layer is etched to expose the electrode terminals.

Prior to forming the thermal transducers 36 and addressing electrodes 33 and common return 35 on surface 30 of the heater plate 28, the opposing surface 40 is anisotropically etched to form elongated groove or recess 44. Alternatively, the transducers and electrodes are masked, so that the etching of the elongated groove 44 may be done last. This recess 44 is parallel to the array of transducers 36 and the bottom 45 of the recess is spaced closely adjacent the heating elements 34 for efficient thermal energy transfer to the fluid circulating therethrough as depicted by arrows 42. The cooling fluid may be any liquid or gas, such as air or water, but is preferably the ink subsequently directed to the printhead manifold 24. A passageway is formed from elongated recess 44 when silicon sealing plate 46, having a pair of anisotropically etched through holes 41 and 43, is aligned and bonded to the heater plate surface 40. The through holes 41, 43 function as inlet and outlet, respectively, for the cooling fluid and enables it to flow to and from the passageway 44. In FIG. 1, the cooling passageway as well as inlet and outlet in sealing plate 46 is shown in dashed line. Tubes 47 having flanges 48 (see FIG. 2) are sealingly attached to the inlet and outlet via gaskets 49. The daughterboard 19 is relieved to form notches 50 that accommodate and provide clearance for the tubes 47.

A cross sectional view of FIG. 1 is taken along view line 2—2 through one channel and shown as FIG. 2A to show how the ink flows from the manifold 24 and around the end 21 of the groove 20 as depicted by arrow 23. As is disclosed in U.S. Pat. Nos. 4,638,337 to Torpey et al, and 4,774,530 to Hawkins, both incorporated herein by reference, a plurality of sets of bubble generating thermal transducers 36 and their addressing electrodes 33 and common return 35 are patterned on the polished surface of a single side polished (100) silicon wafer. Prior to patterning the multiple sets of printhead electrodes 33, the resistive material 34 that serves as the heating elements, and the common return 35, the polished surface of the wafer is coated with an underglaze layer 39, such as silicon dioxide, having a thickness of about 2 μm. The resistive material may be a doped polycrystalline silicon which may be deposited by chemical vapor deposition (CVD) or any other well known resistive material such as zirconium boride ($ZrB_2$). The common return and the addressing electrodes are typically aluminum leads deposited on the underglaze and over the edges of the heating elements. The common return terminals 37 (see FIG. 1) and addressing electrode terminals 32 are positioned at predetermined locations to allow clearance for wire bonding to the electrodes 14 of the daughter board 19, after the channel plate 31 is attached to heater plate 28 to make a printhead and after the sealing plate 46 is bonded to the heater plate 28 to form the cooling path for the circulating cooling medium, which is preferably the ink. The common return 35 and the addressing electrodes 33 are deposited to a thickness of 0.5 to 3 μm, with the preferred thickness being 1.5 μm.

Figure 2B:
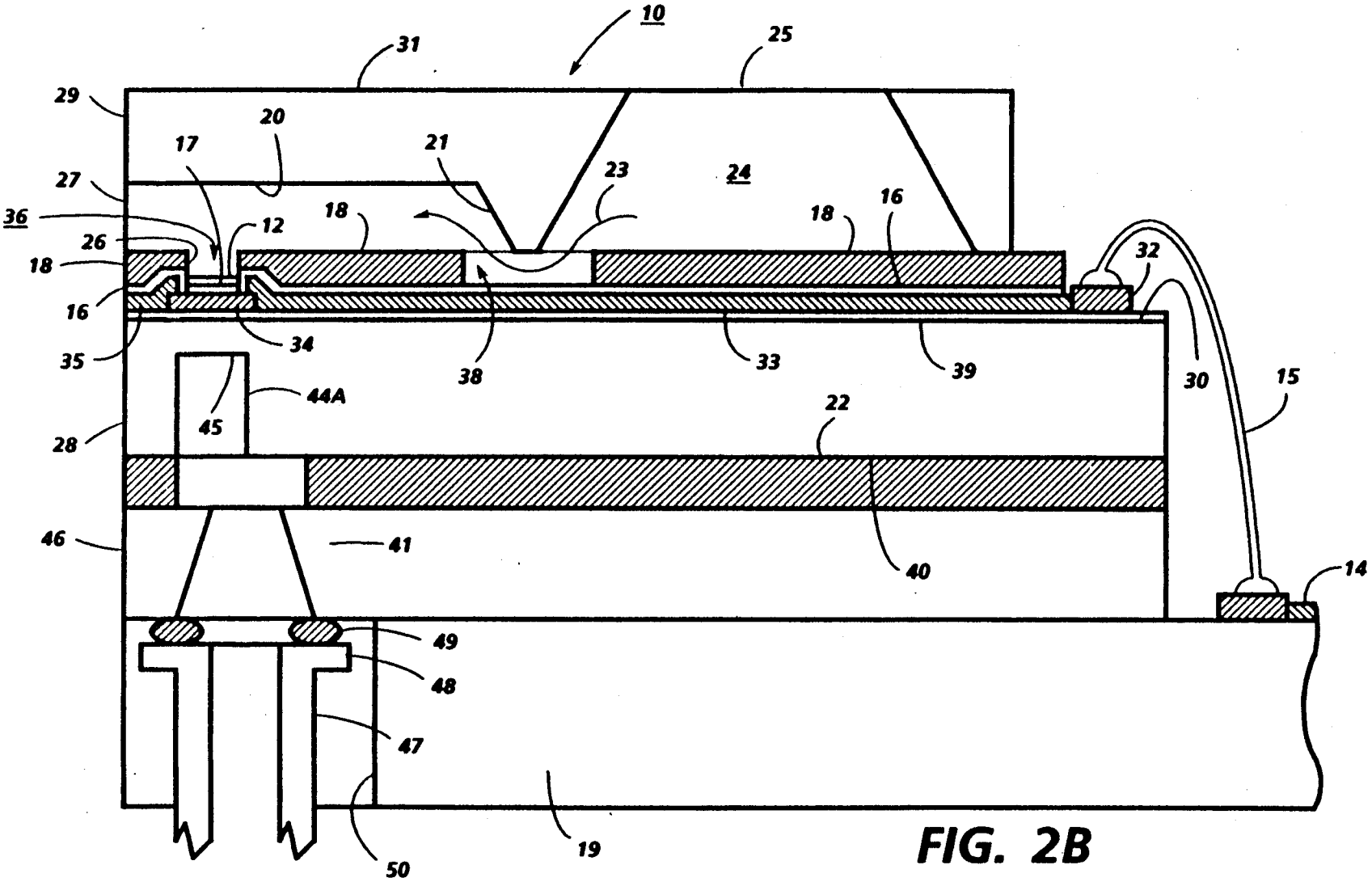
FIGS. 2B and 2C are cross-sectional views of the printhead as viewed along view line 2—2 of FIG. 1, but each showing an alternate embodiment of the present invention.

As indicated above, the elongated recess 44 may be anisotropically etched before or after the thermal transducers and electrodes are formed, but preferably before to eliminate the need for a temporary masking layer over them while the elongated recess is etched. The etching time for the elongated recess is determined to place the recess bottom 45 a predetermined distance from the heating elements 34. The preferred distance between them is about 25 to 50 μm. If anisotropic etching of groove 44 displaces its bottom 45 too far upstream from heating elements 34, then the groove may be formed by reactive ion etching (RIE) or by dicing as shown in FIGS. 2B, 3B, and 3C, discussed later.

In the preferred embodiment and after the elongated recesses have been diced or etched, the silicon heater plate surface 30 is coated with an underglaze layer 39 of thermal oxide or other suitable insulative layer such as silicon dioxide. Polysilicon heating elements 34 are formed and another insulative overglaze layer (not shown) is deposited over the underglaze layer and heating elements thereon. This overglaze layer may be either silicon dioxide thermal oxide or reflowed polysilicon glass (PSG). The thermal oxide layer is typically grown to a thickness of 0.5 to 1.0 μm to protect and insulate the heating elements from the conductive ink. Reflowed PSG is usually about 2 μm thick. The overglaze layer is masked and etched to produce vias therein near the edges of the heating elements for subsequent electrical interface with the aluminum (Al) addressing electrode 33 and Al common return electrode 35. In addition, the overglaze layer in the bubble generating region of the heating element 34 is concurrently removed. If other resistive material such as hafnium boride or zirconium boride is used for the heating elements, then other suitable well known insulative materials may be used.

The next process step in fabricating the thermal transducer is to deposit a pyrolytic silicon nitride layer 17 directly on the exposed polysilicon heating elements, followed by the deposition of a one μm thick tantalum layer 12 for cavitational stress protection of the pyrolytic silicon nitride layer 17.

For electrode passivation, a two μm thick phosphorous doped CVD silicon dioxide film 16 is deposited over the entire heating element plate or wafer surface, including the plurality of sets of heating elements and addressing electrodes. Other passivation layers may be used, such as, for example, polyimide, plasma nitride, as well as the above-mentioned phosphorous doped silicon dioxide, or any combinations thereof. An effective passivation layer is achieved when its thickness is between 1000 angstrom and 10 μm, with the preferred thickness being 1 μm. The passivation layer 16 is etched off of the terminal ends of the common return and addressing electrodes for wire bonding later with the daughter board electrodes. This etching of the silicon dioxide film may be by either the wet or dry etching method. Alternatively, the electrode passivation may be accomplished by plasma deposited silicon nitride ($Si_3N_4$).

Next, a thick film type insulative layer 18 such as, for example, Riston®, Vacrel®, Probimer 52®, or polyimide, is formed on the passivation layer 16 having a thickness of between 10 and 100 μm and preferably in the range of 25 to 50 μm. The insulative layer 18 is photolithographically processed to enable etching and removal of those portions of the layer 18 over each heating element (forming pits 26), the elongated recess 38 for providing ink passage from the manifold 24 to the ink channels 20, and over each electrode terminal 32,37. The elongated recess 38 is formed by the removal of this portion of the thick film layer 18.

In thick film layer 18, the pit 26 is formed to expose each bubble generating area of the multi-layered thermal transducer 36 and elongated recess 38 is formed to open the ink channels to the manifold. The pit walls inhibit lateral movement of each bubble generated by the pulsed heating element which lie at the bottom of pits 26, and thus promote bubble growth in a direction normal thereto. Therefore, as disclosed in U.S. Pat. No. 4,638,337, the blowout phenomena of releasing a burst of vaporized ink, which causes an ingestion of air is avoided.

As disclosed in U.S. Pat. Re. No. 32,572 also incorporated herein by reference, the channel plate is formed from a first (100) silicon wafer to produce a plurality of channel plates 31 for the printhead. The heater plate 28 is also obtained from a second wafer or wafer sized structure containing a plurality thereof. Relatively large rectangular through recesses and a plurality of sets of equally, spaced parallel V-groove recesses are etched in one surface of the first wafer. These recesses will eventually become the ink manifolds 24 and ink channels 20 of the printheads. In accordance with this invention, the second wafer has a plurality of elongated recesses 44 formed in the surface 40 opposite the one to later contain the heating elements, one such recess per heater plate. The elongated recesses 44 may be diced or etched as shown in FIGS. 2A, 2B, and 3A–3C, discussed later. The elongated recesses 44 are aligned to be directly below the heating elements 34, with the most accurate alignment obtained by diced recesses or those etched by RIE. In FIG. 2A, a third silicon wafer 46 is anisotropically etched to produce a pair of through recesses 41, 43 therein, one pair for each elongated recess 44 in the second or heater plate wafer. The through recesses are located so that the third silicon wafer may be aligned and bonded to the surface of the wafer containing the elongated recesses 44 to function as the sealing plates 46 upon dicing to produce a passageway for the circulation of a cooling fluid, with the pair of through recesses serving as inlet 41 and outlet 43. The channel plate and heater plate containing wafers together with the third or sealing plate wafer are aligned and bonded together, then diced into a plurality of individual printheads. One of the dicing cuts produces end face 29, opens one end of the elongated V-groove recesses 20 producing nozzles 27. The other ends of the V-groove recesses 20 remain closed by end 21. However, the alignment and bonding of the above-mentioned wafers places the ends 21 of each set of channels 20 directly over elongated recess 38 in the thick film insulative layer 18 as shown in FIG. 2A, enabling the flow of ink into the channels from the manifold 24 as depicted by arrow 23.

The individual multi-layered printheads are mounted on daughterboards 19 having notches 50 to accommodate the attachment of tubes 47 to the inlet 41 and outlet 43 in the printheads sealing plate 46. Each tube has a flange 48 for convenient fixed mounting to the inlet and outlets via gasket 49.

Alternate embodiments of the invention are shown in FIGS. 2B, 2C and 3B–3D. Referring to FIG. 2B, the elongated grooves 44A in the heater plates 28 beneath the heating elements 34 are formed by either dicing or RIE. If dicing is used, then as shown in FIG. 3C, the diced shots 44B extend entirely through the heater plates 28 and must be plugged on opposite ends by a suitable adhesive 52. If the elongated groove 44A is etched by RIE, as shown in FIGS. 2B and 3B, the groove has vertical walls and may be positioned and aligned to be precisely under the heating elements with the groove bottom 45 spaced therefrom a distance which provides maximum heat transfer from the heating elements to the ink or other cooling fluid circulating therethrough while concurrently not structurally weakening the printhead 10 or the heating plate wafer during any stage of fabrication. Thick film layer 22 may be identical to the thick film layer 18 for convenience and is optionally used to provide a flow path between the etched inlet 41 and outlet 43 in the sealing plate 46 via etched openings 53. As shown in FIGS. 2B and 3B, the etched openings 53 may be elongated slots if the sealing plate inlet and outlets are not aligned with the RIE or diced grooves 44A or 44B, respectively.

Figure 2C:
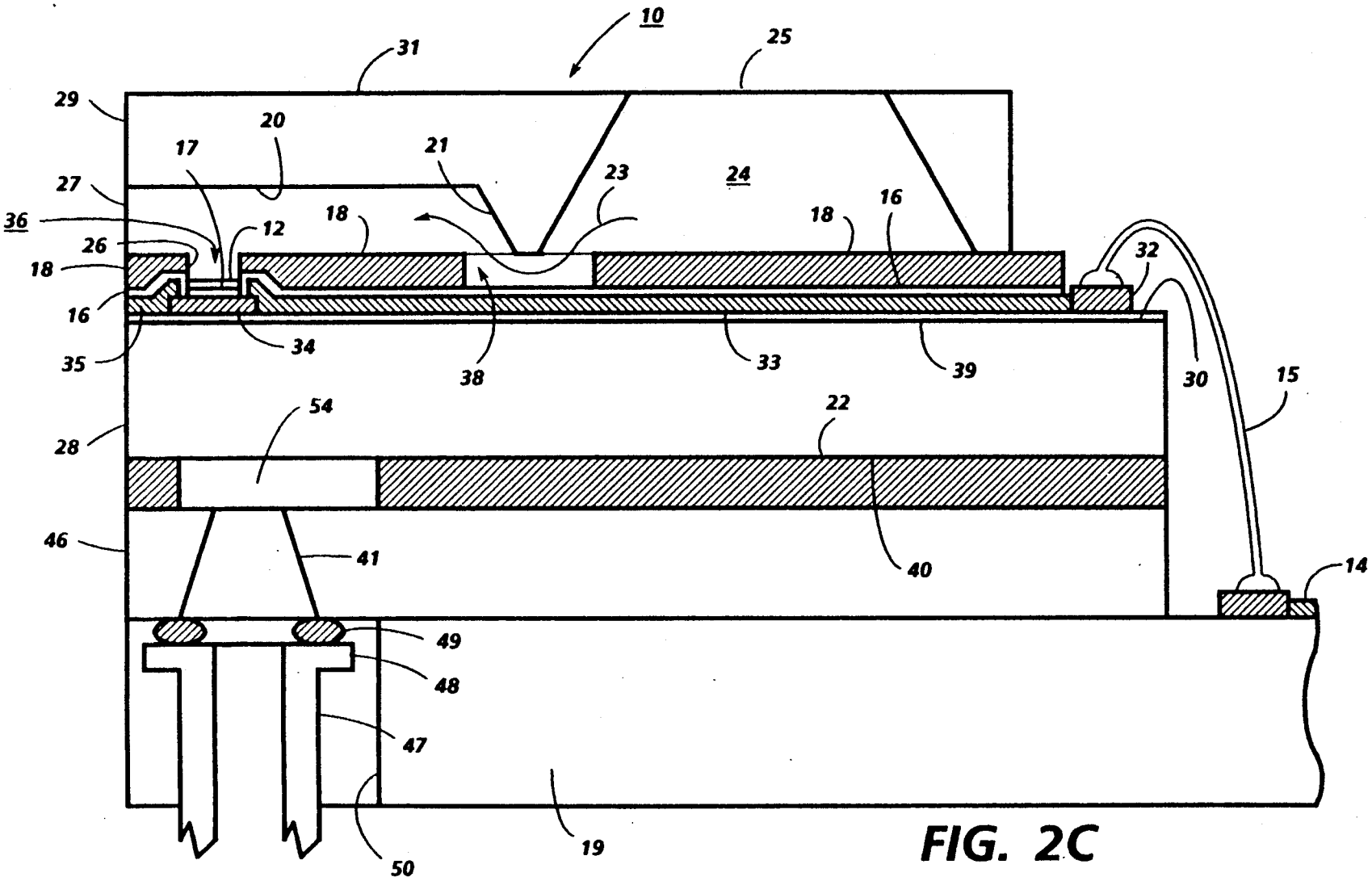
Figure 3A:
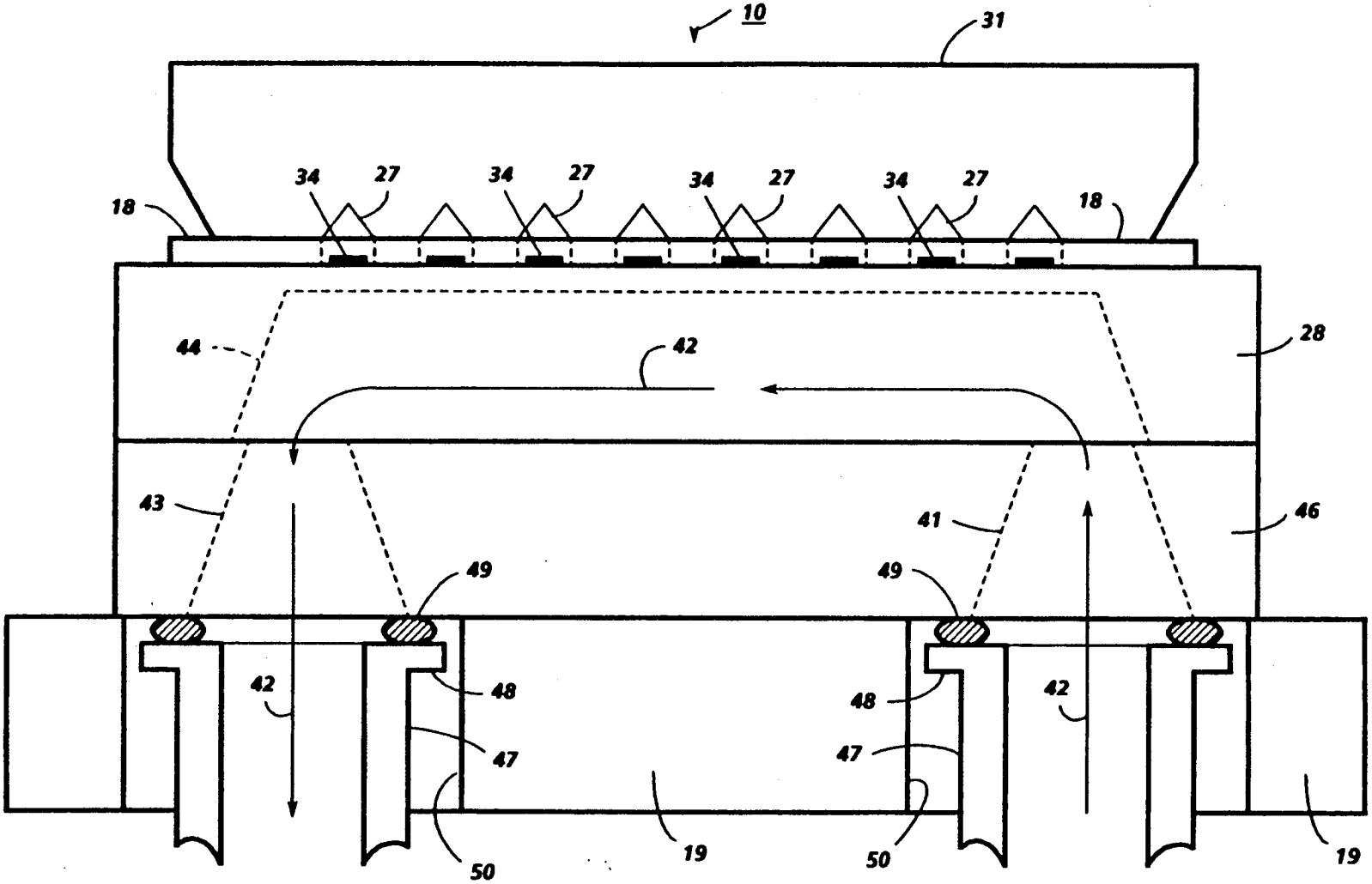
FIG. 3A is a schematic front elevation view of the printhead of FIG. 1 showing the circulation of a cooling fluid in an etched groove underneath the array of heating elements.
Figure 3B:
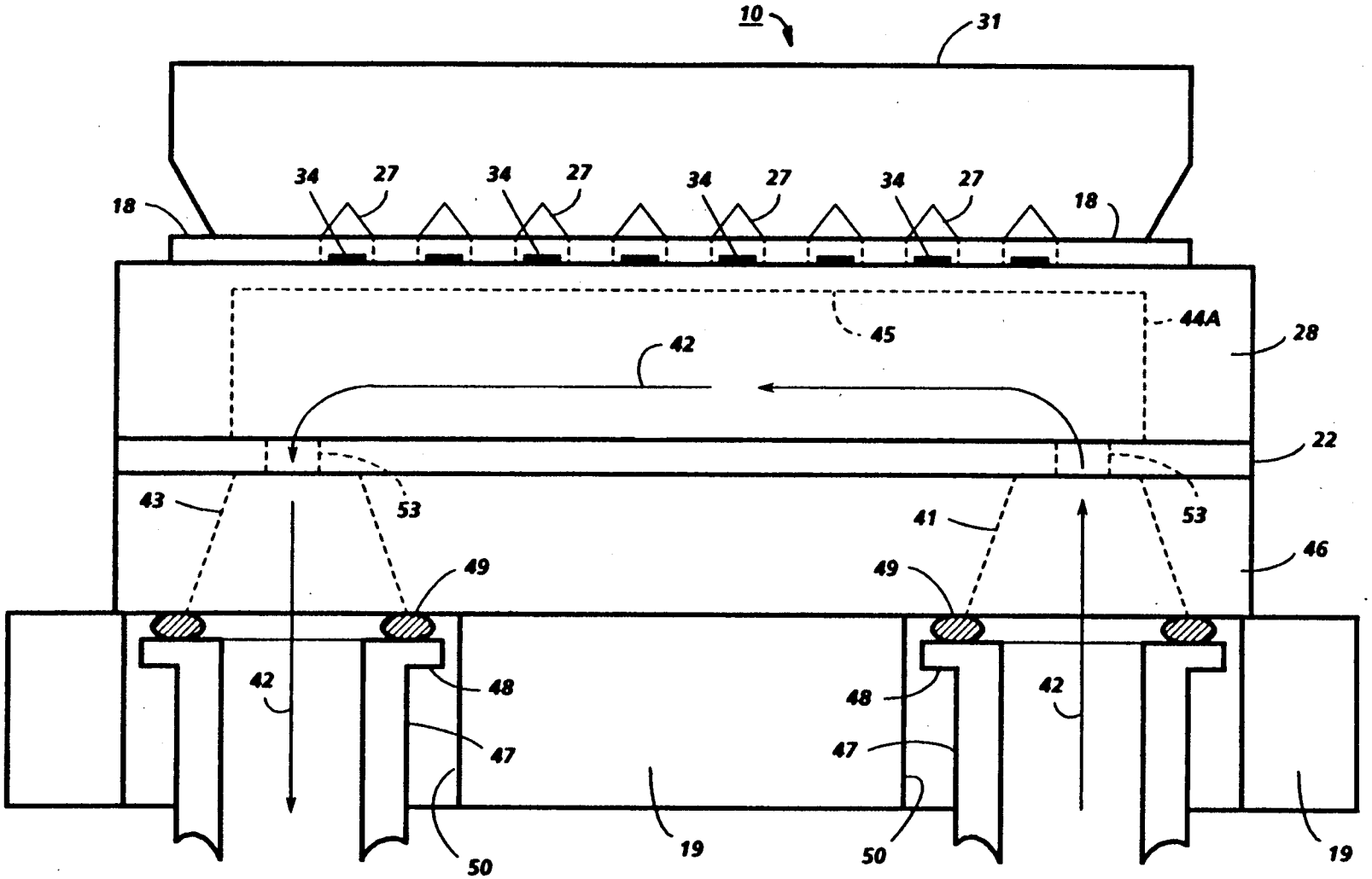
FIGS. 3B, 3C, and 3D are schematic front elevation views of the printhead of FIG. 1 showing alternate embodiments of the present invention.
Figure 3C:
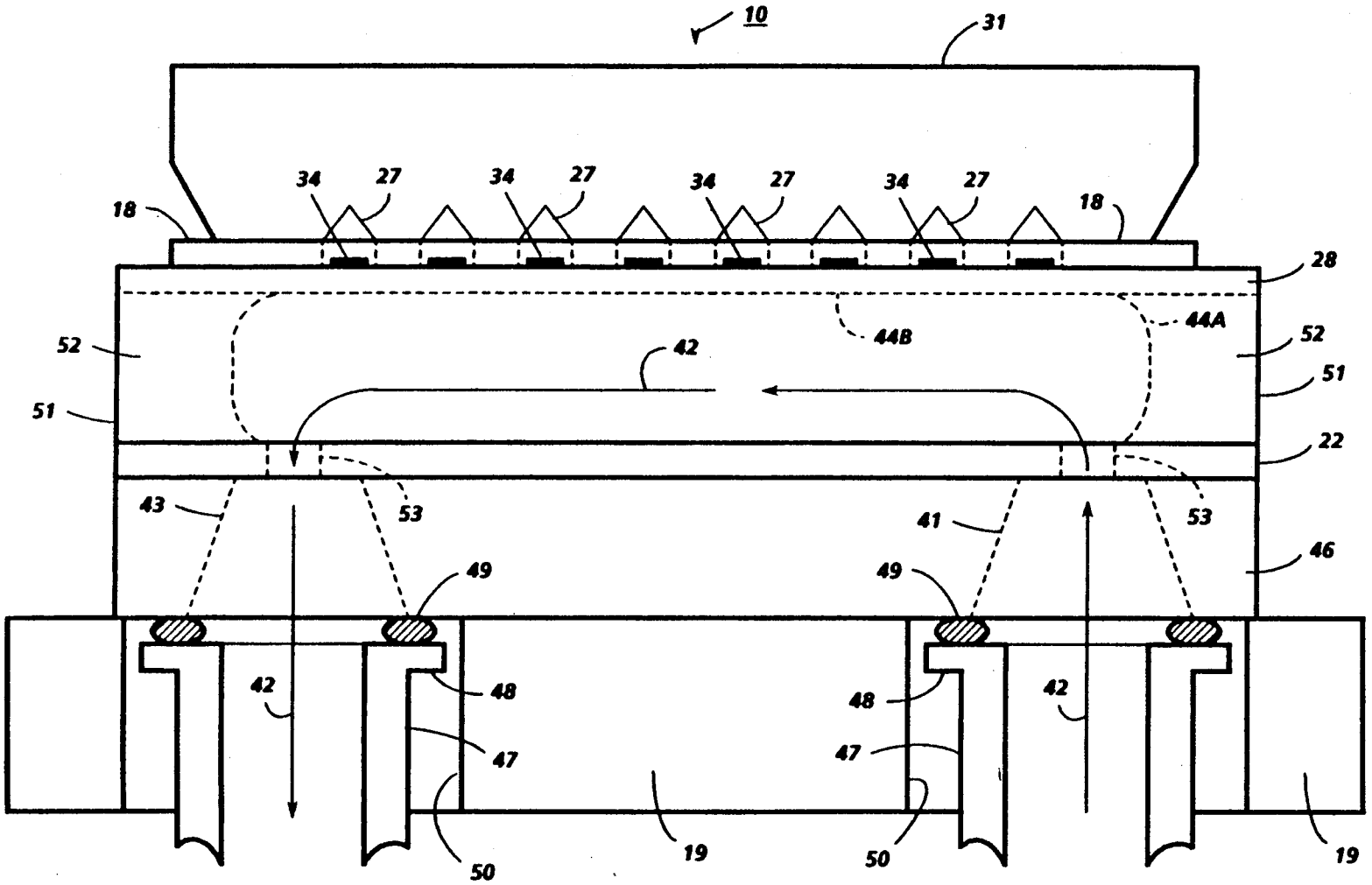
Figure 3D:
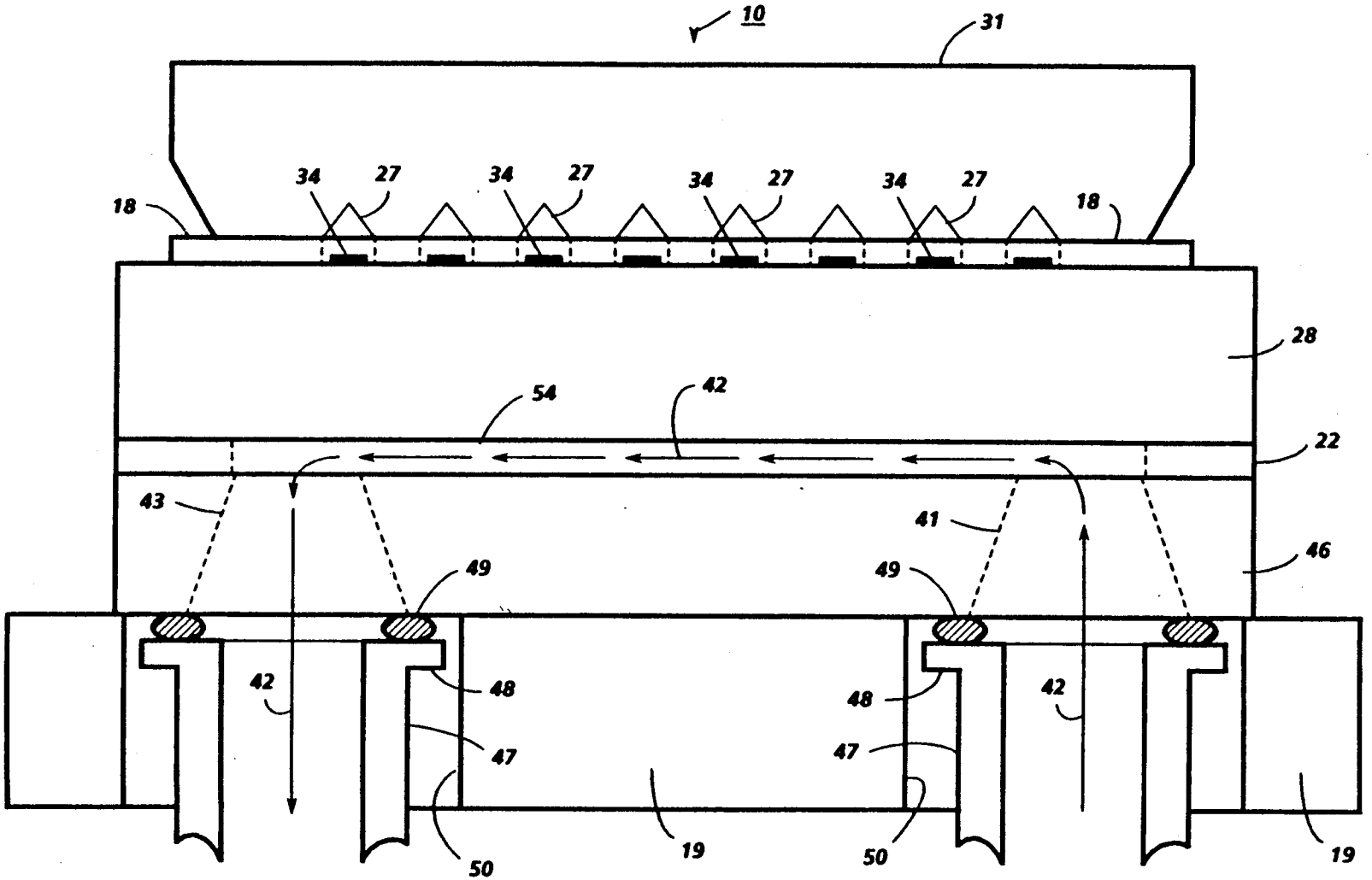

In the embodiment shown in FIGS. 2C and 3D, the coolant groove 54 is patterned in the thick film layer 22 without the need to dice or etch a groove in the heating plate 28.

FIG. 3 is a schematic front view of the printhead 10, showing the passageway formed from the elongated recess 44 and sealing plate 46 in dashed line. Inlet 41 and outlet 43 etched in the sealing plate is also shown in dashed line. The tubes 47 have flanges 48 bonded to the sealing plate with a gasket 49 therebetween. The tubes are shown located in notches 50 of the daughterboard, but there are numerous other well known means to provide access to the sealing plate and outlet, such as, for example, clearance holes (not shown) in the daughterboard which could assist in providing a clamping force to the tube flange. This added clamping force, obtained when the printhead 10 is mounted on the daughterboard 19, would prevent accidental breaking of adhesive bond (not shown) holding the tube flanges and the gasket against the sealing plate. For ease in understanding some of the features of this invention, the heating elements 34 are shown in FIG. 3A in the pits 26 which are shown in dashed line.

FIG. 3B is similar to FIG. 3A, except that the etched groove 44A is produced by RIE and optional thick film layer 22 is shown with openings 53 aligned with sealing plate inlet 41 and outlet 43 to provide for the circulation of the cooling medium through the heater plate 28. FIG. 3C is similar to FIG. 3B, but has a diced groove 44B with opposing open ends 51, which penetrate through both sides of the heater plate 28. The open ends are plugged with a suitable adhesive to form a flow path in accordance with arrow 42 through the heater plate for the circulating coolant, such as the ink. Another embodiment is shown in FIG. 3D which is also a similar view and configuration as that shown in FIG. 3B. In this embodiment, the flow path 42 of the circulating fluid is through an etched channel 54 in the thick film layer 22. This thick film channel may be a straight channel or one having a serpentine path. Since the fluid circulates through only the thick film layer, no change is required in the fabrication of the printhead over that of U.S. Pat. No. 4,638,337 to Torpey et al or U.S. Pat. No. 4,774,530 to Hawkins mentioned above.

Figure 4:
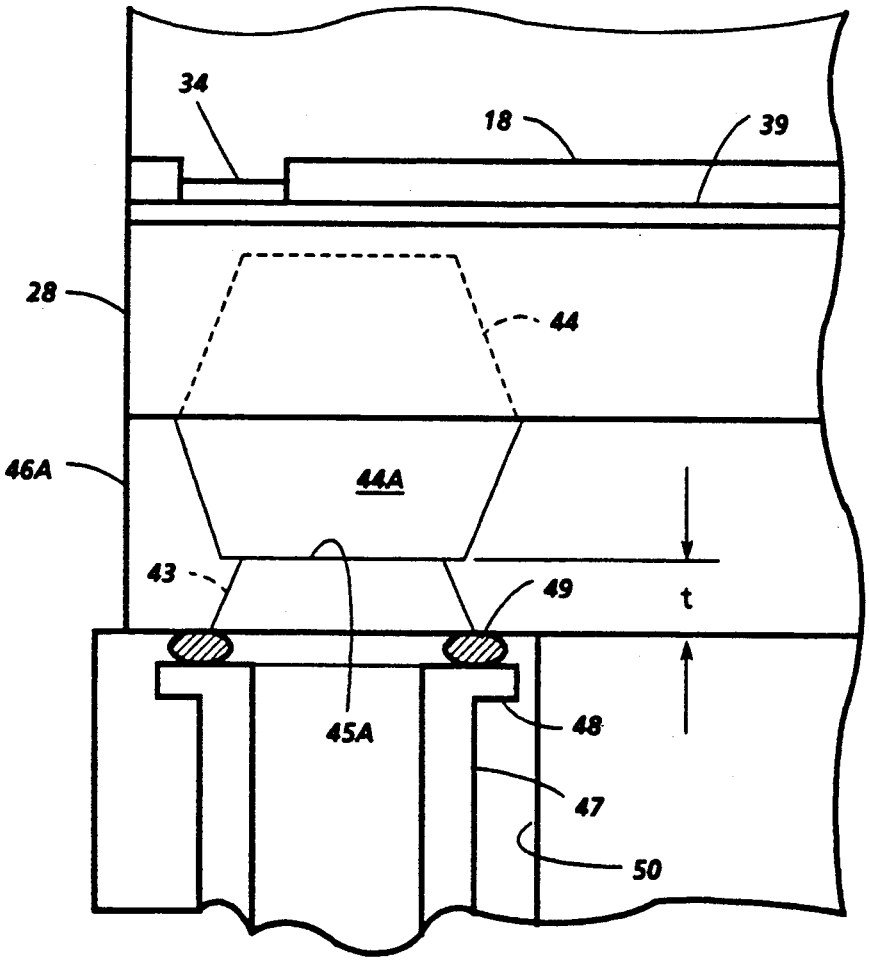
FIG. 4 is a cross-sectional view of an alternate embodiment of the invention.
Figure 5:
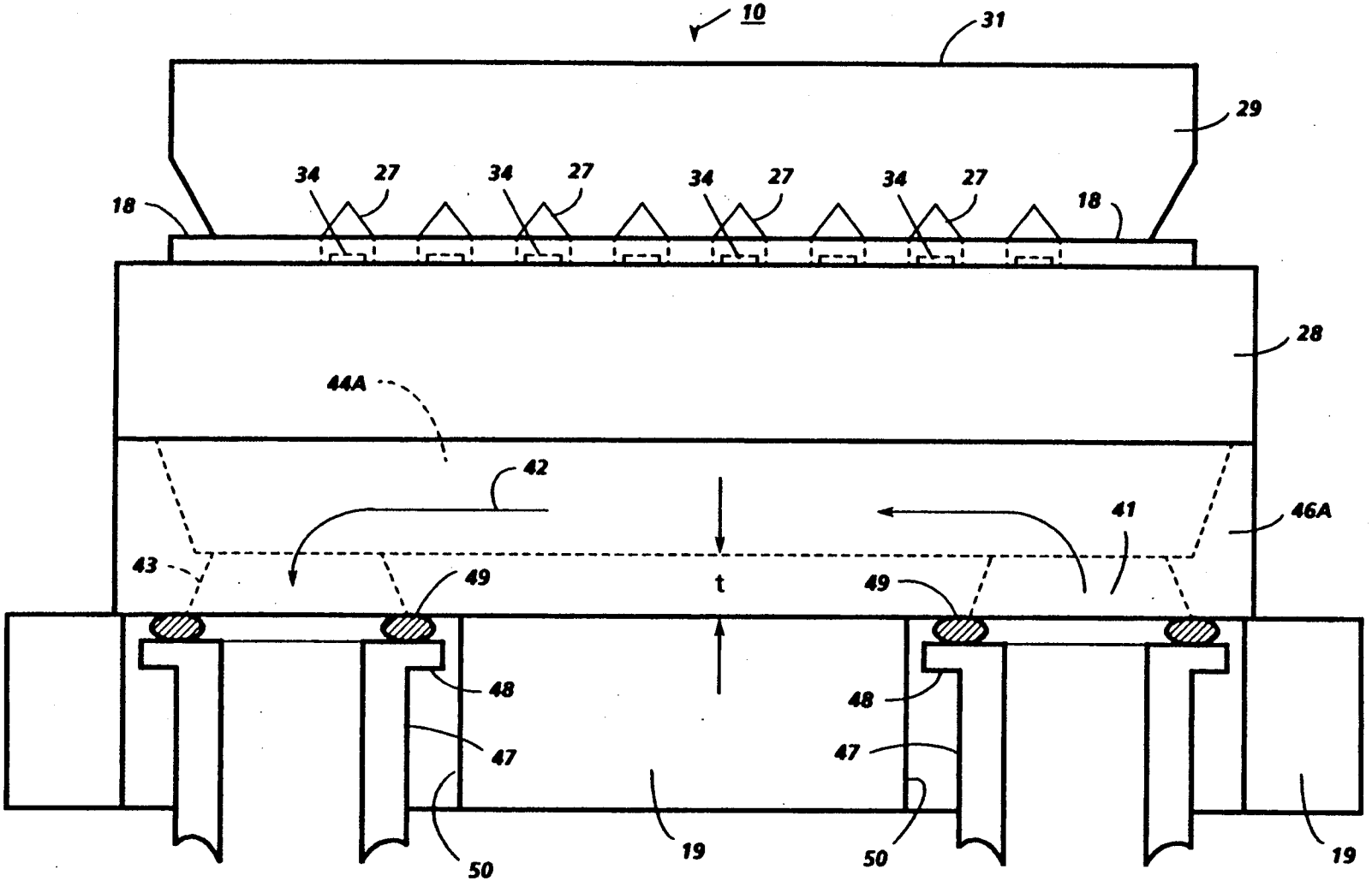
FIG. 5 is a schematic front elevation view of the alternate embodiment of FIG. 4.

FIG. 4 is a partially shown cross sectional view similar to FIG. 2, but showing an alternate embodiment of the invention. FIG. 5 is a front view of the printhead with the alternate embodiment. In these figures, the sealing plate **46*a* contains both the elongated recess 44*a* and the etched inlet and outlet 43. Thus, the circulation of the cooling fluid is done external to the ink jet printheads as disclosed in the above-mentioned U.S. Pat. No. 4,774,530. Optionally, the sealing plate 46*a* could be used with the heater plate 28 of FIGS. 1, 2A and 3 with the elongated recess 44 shown in dashed line for providing a larger reservoir of circulating fluid. During fabrication, the third silicon wafer containing the sealing plates would be anisotropically etched to form a plurality of pairs of relatively small square or rectangular recesses having pyramidal shapes, the apex of each recess having a depth greater than the distance "t" from the floor 45*a* of the subsequently etched elongated recess 44*a*** to the sealing plate surface containing the pairs of etched recesses, so that these small recesses open into the elongated recesses and thereby provide the inlet and outlet for the elongated recess.

In another variation, not shown, the cooling groove could extend across the heater plate and/or sealing plate so that fluid circulating tubes could be inserted and sealed with, for example, an adhesive. This configuration would be especially useful, for example, with the embodiments of FIGS. 3C and 3D because of the diced through slot 44B which requires plugging with an adhesive and the thick film channel 54 which could readily be etched to provide open ends (not shown). In these arrangements (not shown) the sealing plate 46 could optionally be omitted.

There are several advantages of this general architecture, viz., (1) the cooling groove can be quite close to the heaters for efficient removal of heat, (2) the cooling grooves are fabricated by batch processing so they are relatively inexpensive to add and integrate into the overall printhead fabrication process, and (3) all of the plates (i.e., channel plate, heater plate, and sealing plate) are silicon so that thermal mismatch is not a problem.

In recapitulation, a fluid circulation system is employed to regulate the printhead temperature fluctuations during printing by providing a passageway for the circulating fluid through the printhead just underneath the array of heating elements. Prior to heater plate processing, cooling grooves in one embodiment, are etched or diced into the bottom surface thereof. The groove is located directly under the bubble generating resistors and is formed into a tunnel or passageway when a sealing plate is bonded thereto with a pair of etched through holes which may function as a fluid inlet and outlet for the passageway. In another embodiment the cooling groove is in either the sealing plate or an intermediate thick film layer.

Many modifications and variations are apparent from the foregoing description of the invention, and all such modifications and variations are intended to be within the scope of the present invention.

I claim:

1. An improved thermal ink jet printhead of the type having a channel plate with recesses therein which serve as an ink supply manifold, a plurality of ink channels that communicate with the ink supply manifold, and a plurality of nozzles, when aligned and fixedly mated to one of the opposing surfaces of a heater plate, said heater plate surface contacting the channel plate having a linear array of heating elements, one for each nozzle, the printhead ejecting ink droplets on demand by the selective energization of the heating elements with electrical energy pulses having sufficient magnitude to vaporize instantaneously the ink in contact with the energized heating element, so that temporary vapor bubbles are formed which eject said ink droplets, wherein the improvement comprises:

providing a groove with a bottom in the heater plate surface opposite the one having the heating elements, the groove being aligned with and parallel to the heating elements, the bottom of the groove being a predetermined distance form the heating elements; and bonding a sealing plate containing a pair of openings therethrough to the heater plate surface having the groove to form a passageway with the sealing plate openings serving as inlet and outlet thereto for the circulation of a cooling fluid therethrough to prevent temperature fluctuation during the printing operation.

2. The printhead of claim 1, wherein the channel plate and heater plate are silicon.

3. The printhead of claim 2, wherein the groove is formed by etching.

4. The printhead of claim 3, wherein the etching of the groove is by anisotropic etching.

5. The printhead of claim 3, wherein the etching of the groove is by reactive ion etching (RIE).

6. The printhead of claim 2, wherein the groove is formed by dicing and the open ends of the diced groove is closed with an adhesive.

7. The printhead of claim 2, wherein an intermediate thick film layer is sandwiched between the heater plate surface with the groove for the cooling fluid and the sealing plate, the thick film layer having openings formed therein in alignment with the sealing plate openings for the passage of the cooling fluid therethrough.

8. The printhead of claim 1, wherein the predetermined distance between the heating elements and the bottom of the groove in the heater plate is about 25 to 50 μm, so that the cooling fluid being circulated therethrough is quite close to the heating elements for efficient removal of heat.

9. The printhead of claim 1, wherein the sealing plate is silicon having an etched groove in the surface contacting the heater plate with inlet and outlet openings being in communication with said sealing plate groove, the sealing plate groove being confrontingly aligned with the heater plate groove in order to provide an enlarged passageway for circulation of the cooling fluid therethrough.

10. The printhead of claim 1, wherein an intermediate thick film layer is sandwiched between the heater plate surface with the groove and the sealing plate, the thick film layer being patterned to form a channel therein, the channel in said sandwiched thick film layer being aligned with the groove in the heater plate in order to provide an enlarged passageway for circulation of the cooling fluid therethrough.

11. The printhead of claim 10, wherein the cooling fluid is any gas or liquid.

12. The printhead of claim 10, wherein the cooling fluid is the ink which is subsequently directed to the printhead manifold.

13. The printhead of claim 1, wherein the cooling fluid is any gas or liquid.

14. The printhead of claim 1, wherein the cooling fluid is the ink which is subsequently directed to the printhead manifold.

* * * * *